US007331579B2

(12) United States Patent
Snow

(10) Patent No.: US 7,331,579 B2
(45) Date of Patent: Feb. 19, 2008

(54) POKER GAME WITH DEALER DISQUALIFYING HAND

(75) Inventor: Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

(21) Appl. No.: 10/437,726

(22) Filed: May 13, 2003

(65) Prior Publication Data

US 2004/0041346 A1 Mar. 4, 2004

Related U.S. Application Data

(63) Continuation-in-part of application No. 10/016,436, filed on Nov. 1, 2001, now Pat. No. 6,698,759.

(51) Int. Cl.
*A63F 1/00* (2006.01)

(52) U.S. Cl. ..... 273/292; 273/294; 273/309

(58) Field of Classification Search ..... 273/292, 273/274, 309; 463/13
See application file for complete search history.

(56) References Cited

U.S. PATENT DOCUMENTS

| | | | | |
|---|---|---|---|---|
| 4,743,022 | A | 5/1988 | Wood | 273/292 |
| 4,836,553 | A | 6/1989 | Suttle et al. | 273/292 |
| 4,861,041 | A | 8/1989 | Jones et al. | 273/292 |
| 5,022,653 | A | 6/1991 | Suttle et al. | 463/13 |
| 5,046,736 | A | 9/1991 | Bridgeman et al. | 463/13 |

(Continued)

FOREIGN PATENT DOCUMENTS

| | | |
|---|---|---|
| GB | 667345 | 2/1952 |

OTHER PUBLICATIONS

Copyright filing with the Bureau voor de Intellectuele Eigendom, Aruba, 13 pgs (Jan. 13, 1988).

(Continued)

*Primary Examiner*—Eugene Kim
*Assistant Examiner*—Dolores R. Collins
(74) *Attorney, Agent, or Firm*—Mark A. Litman & Associates, P.A.

(57) ABSTRACT

A method of playing a poker-type wagering game is disclosed. The method includes the steps of: a) placing a mandatory Ante bet to participate in a poker-type card game against a dealer hand; b) placing a mandatory Super Bonus bet on the occurrence of one of a predetermined plurality of winning poker hands; c) a dealer dealing at least two hands of cards to the dealer position and a hand of cards to each player participating in the game; d) and when the dealer's first hand meets or exceeds a predetermined high ranking hand value, discarding the first hand and playing the second hand; e) each player placing an additional mandatory Bet after viewing at least the player's hand of cards to stay in the game; f) resolving each player hand against the dealer hand; g) paying the player on the Ante and Bet if the player's hand ranking exceeds that of the dealer; and h) paying the player on the Super Bonus bet if the player hand is one of a plurality of predetermined winning poker hands. The game is preferably played with three cards in a hand, and has additional features such as an optional side bet on the occurrence of a predetermined winning poker hand.

34 Claims, 2 Drawing Sheets

U.S. PATENT DOCUMENTS

| | | | | | |
|---|---|---|---|---|---|
| 5,098,107 | A | | 3/1992 | Boylan et al. | 273/292 |
| 5,174,579 | A | | 12/1992 | Griffiths | 273/292 |
| 5,257,784 | A | | 11/1993 | Boylan et al. | 273/138 |
| 5,257,810 | A | | 11/1993 | Schorr et al. | 273/292 |
| 5,265,877 | A | | 11/1993 | Boylan et al. | 273/139 |
| 5,275,415 | A | | 1/1994 | Wisted | 273/274 |
| 5,288,081 | A | * | 2/1994 | Breeding | 273/292 |
| 5,294,128 | A | | 3/1994 | Marquez | 273/292 |
| 5,308,065 | A | | 5/1994 | Bridgeman et al. | 273/292 |
| 5,366,228 | A | | 11/1994 | Kangsanaraks | 273/292 |
| 5,377,973 | A | | 1/1995 | Jones et al. | 273/292 |
| 5,377,993 | A | | 1/1995 | Josephs | 463/12 |
| 5,382,025 | A | * | 1/1995 | Sklansky et al. | 273/292 |
| 5,397,128 | A | | 3/1995 | Hesse et al. | 273/292 |
| 5,431,408 | A | | 7/1995 | Adams | 273/306 |
| 5,489,101 | A | * | 2/1996 | Moody | 273/292 |
| 5,505,449 | A | | 4/1996 | Eberhardt et al. | 463/17 |
| 5,531,448 | A | * | 7/1996 | Moody | 273/292 |
| 5,538,252 | A | | 7/1996 | Green | 273/306 |
| 5,584,486 | A | | 12/1996 | Franklin | 273/292 |
| 5,630,757 | A | | 5/1997 | Gagin et al. | 463/43 |
| 5,653,444 | A | | 8/1997 | Dahl | 273/274 |
| 5,673,917 | A | | 10/1997 | Vancura | 273/292 |
| 5,685,774 | A | * | 11/1997 | Webb | 463/13 |
| 5,732,950 | A | | 3/1998 | Moody | 273/292 |
| 5,794,934 | A | * | 8/1998 | Malcolm | 273/292 |
| 5,848,790 | A | * | 12/1998 | Huynh | 273/292 |
| 5,868,392 | A | * | 2/1999 | Kraft | 273/292 |
| 6,056,641 | A | * | 5/2000 | Webb | 463/13 |
| 6,170,827 | B1 | * | 1/2001 | Lombardo et al. | 273/292 |
| 6,237,916 | B1 | * | 5/2001 | Webb | 273/292 |
| 6,270,405 | B1 | * | 8/2001 | Ferguson | 463/13 |
| 6,279,910 | B1 | * | 8/2001 | de Keller | 273/292 |
| 6,345,823 | B1 | * | 2/2002 | Webb | 273/292 |
| 6,390,474 | B1 | * | 5/2002 | Terminel et al. | 273/292 |
| 6,561,897 | B1 | * | 5/2003 | Bourbour et al. | 463/13 |
| 6,626,433 | B2 | * | 9/2003 | Scibetta | 273/292 |
| 6,698,759 | B2 | * | 3/2004 | Webb et al. | 273/292 |
| 6,719,291 | B1 | * | 4/2004 | deKeller | 273/274 |
| 6,752,394 | B2 | * | 6/2004 | Malcolm | 273/292 |
| 7,118,112 | B2 | | 10/2006 | Kenny et al. | 273/292 |
| 7,195,243 | B2 | | 3/2007 | Kenny et al. | 273/292 |
| 2002/0175468 | A1 | | 11/2002 | Kenny et al. | 273/274 |
| 2004/0150163 | A1 | | 8/2004 | Kenny et al. | 273/292 |
| 2004/0160006 | A1 | | 8/2004 | Kenny et al. | 273/274 |
| 2006/0108740 | A1 | | 5/2006 | Kekempanos et al. | 273/292 |
| 2006/0119044 | A1 | | 6/2006 | Kekempanos et al. | 273/292 |
| 2006/0186599 | A1 | | 8/2006 | Kenny et al. | 273/292 |
| 2006/0226605 | A1 | | 10/2006 | Kenny | 273/292 |
| 2007/0063442 | A1 | | 3/2007 | Kenny et al. | 273/292 |
| 2007/0080497 | A1 | | 4/2007 | Kenny et al. | 273/292 |

OTHER PUBLICATIONS

Published Rule Sheet for Casino Poker from Vegas World (1pages) (1982).

"Card Craps", Scame's Encyclopedia of Card Games, pp. 321-323, (1948).

"Prime Table Games-Disclosure in Respect to Three Card Games," Derek J. Webb, Author, Feb. 10, 1999.

* cited by examiner

POKER GAME WITH DEALER DISQUALIFYING HAND

RELATED APPLICATIONS

The present application is a continuation-in-part of U.S. patent application Ser. No. 10/016,436, filed Nov. 1, 2001, now U.S. Pat. No. 6,698,759.

BACKGROUND OF THE INVENTION

1. Field of the Invention

The present invention relates to games, more particularly to card-type games that are suitable for use in gaming establishments, and more particularly to poker-type card games that are suitable for use in gaming establishments such as table games and as video games.

2. Background of the Art

Casinos and leisure establishments continually require new games to offer their clientele. Such games are generally required to enable each player to play against a banker (who usually also acts as dealer) provided by the casino, rather than against other players. Alternatively, in a "card room" game each player may have the option to act as banker, whilst the establishment runs the game on behalf of the banker and takes fees from the players.

Players typically enjoy games which can be played rapidly and which offer players a plurality of game play choices. A plurality of choices heightens player interest in games. It would therefore be desirable to provide card games comprising a plurality of new wagering options.

Let it Ride Bonus® Stud Poker, as disclosed in Breeding U.S. patent application Ser. No. 09/495,149 filed on Jan. 31, 2000 entitled MULTI-TIERED WAGERING METHOD AND GAME, the content of which is hereby incorporated by reference, describes a primary card game in which the player plays a 5 card poker game. In the base game, a player makes a three part wager on the occurrence of one of a number of predetermined winning hands. Each player is dealt three cards, and the dealer is also dealt three cards. One dealer card is discarded, and the other two cards are placed face down on the table. The dealer cards are community cards. That is, the cards are part of every player's hand on the table. Also, the players are not playing against the dealer's hand but are instead trying to achieve one of a predetermined number of winning hands. The player may withdraw a first portion of his bet after he has examined his partial three-card hand. The two community cards are used by each player to form a five card hand. After the dealer turns the first community card face up, the player is given the opportunity to withdraw a second portion of his bet. The third bet must remain at risk.

Standard five-card poker rankings are used to determine the hierarchy of payouts. The hands that pay (highest to lowest) in a typical LET IT RIDE® basic game are: royal flush, straight flush, four of a kind, full house, flush, straight, three of a kind, two pair, and a pair. Each winning hand pays odds, and all winning outcomes and corresponding payout odds are listed in a pay table on the table felt. Optionally, the player can place a side bet on the occurrence of certain high ranking hands within the predetermined set of winning outcomes in the base game. Both the player cards and the dealer's common cards are used to define the player's hand and corresponding hand ranking in the side bet game. Players are required to make a multiple part bet, and can optionally withdraw part of the bet upon viewing some of the cards.

It would be desirable to provide a poker-style game with a simplified betting structure and dealing procedures that provides a player with sufficient betting options to maintain player interest, and follows the rules of poker, as poker rules are well known throughout the world. It would also be desirable to offer different dealing procedures and betting formats that appear more favorable to the player.

SUMMARY OF THE INVENTION

In one form of the invention, a casino wagering game is provided in this disclosure that comprises: 1) a player placing at least a single part wager to participate in the game; 2) a dealer dealing a hand of three cards to each player who placed a wager; and 3) resolving the player hands according to a predetermined hierarchy of three card poker hands. In one form of the invention, or in one procedure used to resolve multiple wagers placed on the same hand by the player, at least one wager on individual hands may be resolved against a pay table of predetermined winning poker outcomes and corresponding odds. Players are paid odds (payouts that are multiples of an amount wagered) when their hand consists of a predetermined winning outcome. This form of the invention is referred to as "the game against the pay table."

In a preferred form of the invention, the game is played as a live casino card game with physical cards, comprising the steps of: placing a single part wager to participate in a casino wagering three-card poker type game; dealing a hand consisting of three cards to each player who placed a single part wager; and resolving each player's hand according to the rules of poker against a payout table providing payouts for predetermined ranks of poker-type hands; wherein at least some of the payouts are proportional to the single part wager in resolving hands.

The present invention is also a method of playing a casino card game utilizing a standard deck of cards, comprising the steps of: placing a wager to participate in a three card poker game against a dealer; dealing three cards to the player; dealing at least three cards to the dealer; and resolving the hands according to the standard rules of poker. For purposes of this disclosure, this form of the invention is referred to as "the game against the dealer."

The three-card hand against a pay table may be played individually, or in combination with a three-card game against a dealer. The three-card game against the dealer may be played individually, or in combination with a three-card game against a pay table. The bets on each segment of the game may be mandatory, or optional. Bets on both games are mandatory in one example of the invention. Bets against the pay table and against the dealer hand may also be equal or unequal.

Other examples of the invention include playing one or more of the three-card games in combination with other game segments as well. For example, in combination with placing a wager on a three card-hand against a pay table, the player can bet one or more additional wagers on the occurrence of a five-card poker hand, for example, where the player receives at least two additional cards after the resolution of the three-card hand, either in the form of dealt cards, dealer hand cards or common cards. Or, the player can place an additional side bet on the occurrence of one of a predetermined high ranking hand combinations, such as a straight flush, for example.

The three-card poker game play methods of the present invention may be practiced as house banked games, or player banked games. When a game is house banked, the dealer is also the banker. When a game is player banked, the house provides a dealer, and the players take turns acting as banker. The house takes a commission either at a flat rate, or takes a percentage of bets placed. Typically the players have an option to pass on the opportunity to act as banker in the game.

In another form of the invention, the dealer deals a hand of cards to each player, and two or more hands of cards to the dealer, either 1) both hands at the same time with only a first hand exposed or both hands remain hidden, or 2) the second hand is dealt and then exposed only when a first dealer hand is exposed and meets a predetermined condition that disqualifies the hand. The player plays with only the single hand dealt to the player. The dealer plays with only one hand, but under circumstances described herein, a first hand may be replaced with a second hand.

The number of cards in each player hand and each dealer hand are equal, and is preferably equal to three cards. The number of cards can also be more or less, such as two, four, five, six or seven card hands. The player must make an ante bet and a super bonus bet to participate in this form of the game. The ante bet is a bet against the dealer's hand, and the super bonus bet is a bet that the player achieves a predetermined winning card combination, for example, where each winning combination is identified in a pay table. After the player has had a chance to view his cards, he must make an additional play bet, or must fold, losing the ante and play wager to the house. The player still has an opportunity to win on the super bonus bet regardless of the ranking of the dealer's hand if the player hand is of a minimum predetermined ranking, with the rules specifying whether or not the player has to make the play bet to stay in the game. That is, the player may be required to make the play bet to keep the super bonus bet alive, or may forfeit the ante bet and yet have the super bonus bet remain active.

According to one form of the invention, the dealer must have a hand lower than or equal to a predetermined maximum ranking in order to play the first hand against the player. For example, according to one set of rules, the dealer may be required to discard his hand if the dealer's hand is a flush or better. If the hand is not sufficiently low ranking according to the rules, the dealer must discard the first dealer hand and play with another hand, for example, a second hand. The second hand, as indicated may have been previously dealt and remains face down until needed, or may be separately dealt to the dealer once the first hand has been found to meet or exceed a predetermined rank. The dealer second hand preferably has a minimum qualifying ranking to play against the player. For example, the dealer may need to have a Jack high or better to qualify to play against the player. After examining the cards, each player must either place an additional play wager or fold. In most circumstances, the game will be played where folding the ante wager also folds the super bonus wager, which would be logical since the player would remain if a super bonus ranked hand were present. When the dealer qualifies, and the player has made the play bet to stay in the game, if the player's hand beats the dealer hand, the player is paid 1:1 odds on the ante and play bets. Upon placing one or more additional bets, additional odds may be paid for ranked hands on either or both of the ante and play bets. In one form of the invention, the player places a super bonus bet at the beginning of the game, and loses the super bonus bet unless his hand is of a minimum predetermined rank. In the same example, if the hand is not of a high enough predetermined rank, but still beats the dealer's hand, the super bonus bet is a push. In other words, this bet is not always lost when the player hand is not of a minimum qualifying rank. The super bonus bet may also be retained (if the rules are so structured) if the dealer does not qualify, or if the dealer does not qualify and the player hand beats the dealer hand, or even if the dealer does not qualify and the player's hand is specifically lower then the rank of the dealer hand. The player may also place an optional additional bonus wager (a pair plus bet) on the occurrence of one of an array of predetermined hands and corresponding payout odds (i.e., a bet against a pay table). Play on the optional bonus wager in one form of the invention is tied to the base game—that is when the dealer's hand beats the player hand, the house sweeps all bets, including the optional pair plus bet. In another form of the invention, the pair plus bet is separate from the play of the base game. That is, the player may win on the bonus wager (for obtaining a predetermined hand ranking) regardless of the outcome of the base game. This form of a preferred example of the game of the present invention is referred to as Oklahoma Three Card™ poker.

BRIEF DESCRIPTION OF THE DRAWINGS

Embodiments of the invention will now be described, by way of example only, with reference to the accompanying drawing, in which.

DETAILED DESCRIPTION OF THE INVENTION

Figure 1:
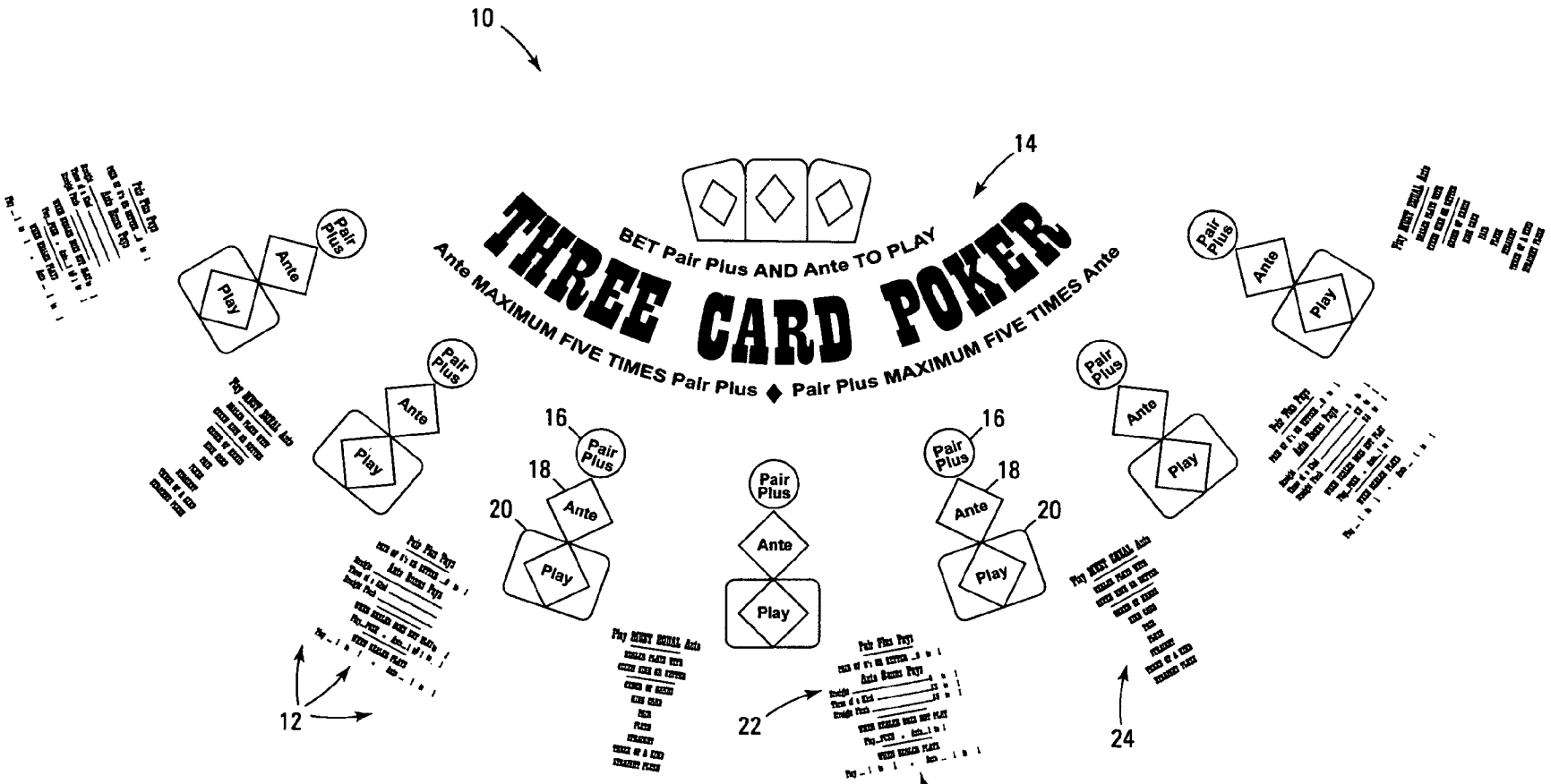
FIG. 1 shows a playing surface for use in playing a card game of one embodiment of the present invention.

One method exemplary of play of the present invention is described as follows. A player provides or makes at least two initial wagers, 1) an Ante bet and a Super Bonus bet. The ante bet is a wager in at least a dealer versus player game (and optionally may include a play against a pay table) and the super bonus bet is a wager at least against a pay table. After making the at least two wagers, the player is provided with a player hand. The player hand is preferably a three-card hand, but can be a two, four, five, six or seven card hand. The dealer is then or later provided with at least one dealer hand, equal in number of cards to the player hand. The player inspects the player hand and determines if continued play in the hand (without the player receiving additional cards) is sound strategy.

According to the invention, when a three card hand is played, the following hand rankings are used (from highest to lowest):

Straight Flush
Three of a Kind
Straight (A-2-3 is the lowest straight)
Flush (three cards of the same suit)
One Pair
High Card If the player determines that continued play of the hand is sound strategy or that is the player's decision, the player makes a Play wager that is equal to (or less preferably unequal than) the ante bet to stay in the game. The Play and Ante wagers are made on a game of at least the player hand versus the dealer hand (and optionally may include a play against a pay table). In one form of the invention, if the player folds, the house automatically takes the Ante and Super Bonus bets. There may also be an optional pair plus wager, in which a player wagers that the hand dealt to the player will have a rank of at least one pair or other predetermined card combination. That wager is played against a pay table, with different multiple return pay outs based on the rank of the hand of at least a pair (or a specific pair, e.g., at least a pair of 3's). The dealer then inspects the dealer hand (usually with the dealer hand being displayed to all players after all players have concluded their elections to make their play bets of fold). If the dealer hand is equal to or greater than a predetermined disqualifying high rank (e.g., at least a flush, at least a pair of Aces, etc.), the dealer is required to fold that hand and play a second hand. The disqualification of a hand that is too high in rank is believed to be a novel feature of the present invention.

A second hand for the dealer is displayed to the players, and that second hand must become the dealer hand for the play of that round of the game. The dealer hand is displayed and all remaining wagers are resolved according to the rules of the game. The preferred rules may comprise that the Ante wager is paid at a fixed rate (e.g., 1:1) in a competition of rank against the dealer hand. The Play bet may also be paid at a fixed rate (e.g., 1:1) in a competition of rank against the dealer hand. The Super Bonus bet is resolved and paid against a pay table, and may or may not be paid for bonus rank hands regardless of whether the player hand exceeds the rank of the dealer hand. Different pay tables may be provided for when the player hand exceeds or loses to the rank of the dealer hand, or an additional fixed rate of payout (e.g., 1:1) may be made on the super bonus wager depending on whether or not the rank of the player hand exceeds the rank of the dealer hand or ties the rank of the dealer hand. The wager on the optional pair plus wager is resolved against a pay table (and optionally may include a fixed rate payout or a different pay table if the rank of the player hand exceeds the rank of a dealer hand or not).

A novel aspect of play in this game is the fact that a first dealer hand of high rank disqualifies the hand from play and must be discarded. This provides an incentive to players to continue in the game knowing that the dealer must surrender (discard or void) any hand meeting or exceeding a predetermined high ranking hand. This reduces the frequency of occurrence of players having good ranking hands (e.g., a high pair or low straight) that are beaten by better dealer hands. All pay table wagers, in one example of the invention should be paid whether or not the rank of the player hand exceeds the rank of the dealer hand. In one form of the invention, these wagers (the super bonus bet and the pair plus bet) may be kept in play whether or not the player makes a play wager. The pair plus bet should remain in play with or without the player making a play bet, as this is an optional bet, and the player is likely to remain in the game and make the play wager with any pair, although errors may occur during play. The super bonus bet may be treated in the same or different manner, either allowing that wager to remain in play whether or not the player makes a play bet, or not.

The play of the game may also require a dealer minimum qualifying hand to occur before the play wager is paid. That is, if a play wager has been made by a player, the dealer must have at least a predetermined rank hand (such as with Jack high, for example), or the dealer hand is removed from play, effectively folding the hand and not 'calling' the wager. When the dealer does not qualify to play, the Ante pays even money and the Super Bonus is a push, unless the player has a pair of sixes or better, in which case the hand pays odds.

Payout odds typically are printed on the playing surface and are referred to as a "pay table". One exemplary pay table for the pair plus wager of a three card poker game of the present invention is outlined below:

| Hand | Payout Odds |
|---|---|
| Straight Flush | 40:1 |
| Three of a Kind | 30:1 |
| Straight | 6:1 |
| Flush | 4:1 |
| Pair | 1:1 |

The standard rules of five-card poker rank hands in the following descending order: Royal flush, straight flush, four of a kind, full house, flush, straight, three of a kind, two pair and a pair. According to a preferred form of the invention, for a three card game—four of a kind, full house and two pair are not included as those outcomes require more than three cards. A royal flush (A-K-Q of the same suit in three-card poker) beats a straight flush. In three card poker, the order of certain hands (flush, straight and three of a kind) is inverted. The change in ranking is dictated by the frequency of occurrence of those three card hands. Although the minimum winning card combination in this example is a pair, the invention contemplates other minimum hands, such as a single face card or a high ranking pair, such as a pair of 10's or better. Proportional payouts are typically between 1:1 and 100:1 against the first single part wager, although other payout schemes are contemplated.

In one form of the invention, the player wins the pair plus bet only when he obtains a predetermined winning hand rank (e.g., at least a pair or at least Ace high), and the player loses by not having attained the minimum hand rank required to win the pair plus bet. If the player does not attain that minimum rank, the house takes the bet, whether or not the dealer hand qualifies. In another form of the game, when the game described above is played in combination with a poker hand against a dealer hand, and the player's hand is not a predetermined winning hand, the super bonus bet is returned to the player when the player hand is higher ranking than the dealer hand, even if the minimum rank is not attained. For example, the player might hold an Ace-2-6 hand, while the dealer holds a King-9-10 hand. The minimum winning hand listed on the pay table above is at least a pair of a specific rank (e.g., pair of 6's) for the super bonus bet. The player does not have a pair, but an Ace high beats a King high so the Super Bonus bet is a push, rather than lost to the house.

In one form of the invention, at least one but fewer than all possible payouts on the optional pair plus bet and the super bonus bet (against a pay table) are proportional to the single part wager (or optionally in proportion to the amount of the pair plus bet or the super bonus bet, respectively, which amount may be independent of a relationship to the amount of the Ante or the Play bets individually or independently tied to that Ante amount). Payout methods may include fixed amounts (regardless of the amount wagered), odds payouts (payment of the amount wagered times the pay table multiple), a percentage of a jackpot or a jackpot amount. The pay table may contain one or a combination of different payout methods, according to the invention.

One method of the invention comprises the player placing an optional pair plus wager in addition to the required Super Bonus and Ante wagers to participate in a head to head game against the dealer, wherein the dealer also preferably receives a hand of at least three cards. Preferably, the dealer and players are each dealt a three card hand. It might be necessary to increase house odds, depending upon the specific game rules selected. This can be easily accomplished by dealing one or more extra cards to the dealer, and allowing the dealer to use his or her best three card combination in an attempt to beat the player hands. The pair plus wager may be optional or mandatory. In fact, the Super Bonus bet may also be optional, or both the Pair Plus and Super Bonus wagers may be mandatory.

One way to alter the house advantage in favor of the player is to provide a maximum hand ranking that when achieved by the dealer requires the dealer to disqualify the hand and to discard all or part of the dealer hand and receive new cards. In one preferred form of the invention, the dealer deals himself two hands of cards during the play of the game. The hands are preferably both dealt to the dealer face down at the beginning of the game, with one hand specifically positioned as a first hand (or merely one hand randomly selected as a 'first' hand) and another hand specifically positioned (e.g., into marked areas on the table) as the second hand. The dealer plays with the first hand. But if the dealer's original hand is a flush or better (or other disqualifying rank on a dealer hand, such as pair of Aces), the dealer must discard the entire hand and play the second hand. Then, if the dealer has a minimum qualifying hand such as a Jack high or better, the dealer may play the game against the players. The player is permitted to view his three card hand. If the player wishes to stay in the game, in one example of the invention, the player must make a Play bet at least equal to the ante. If the player stays in the game and the dealer does not qualify, the Play bet and Ante (the two bets are made against the dealer hand) are at a minimum returned to the player. Ordinarily, the Ante should also be paid at a 1:1 rate because the dealer has effectively folded. The super bonus bet (against the pay table) is or may be at least a push if the player hand beats the dealer hand (such as a pair of sixes or better). If the player hand is at least a minimum predetermined ranking, the bet pays odds regardless of whether the dealer qualifies or the player wins the game against the dealer.

According to the invention, the game may be house banked or player banked. When the game is player banked, the house collects a flat commission on each hand at the beginning of play, or collects a percentage of the amount bet, depending upon the gaming regulations of the particular jurisdiction. For example, California card rooms are only permitted to collect a flat commission on each hand. When the game is player banked, players are given the opportunity to bank the game. The player who agrees to bank a hand takes all wagers lost by each player, and must pay all winning payouts. Players typically have the option to bank the game, but are not required to do so. In the state of California, for example, corporations exist that bank the games. An employee of the corporation will play the game and act as banker on behalf of his employer. According to the present invention, the game may be played as a player banked game, or as a traditional house banked casino game.

In one form of the invention, when the player participates in a three card poker game against the dealer, he is required to place an additional "Play" wager or "Play" bet to stay in the game. This third wager may be smaller, larger or equal to the amount wagered against the dealer, but is equal to the Ante in one example of the invention. Preferably, the player is permitted to view his three card hand prior to deciding whether to make the Play wager or fold. In another form of the game, the player is optionally permitted to make the Play wager after viewing his cards, but is not required to fold if he elects not to make the Play wager.

When the player plays a three card poker game against the dealer, it is sometimes preferable to require the dealer to have a qualifying hand. This qualification requirement may represent a minimum ranking, or a maximum ranking, or both. For example, the rules might require the dealer to have at least a minimum of a single queen or jack (queen or jack high) in order to qualify to play against the player. In one example of the invention, the Ante is paid 1:1 and the Play and super Bonus bets are a push when the dealer does not qualify. In another example of the invention, the Ante pays 1:1 and the Play bet is returned when the dealer does not qualify.

In yet another example of the invention, the dealer is required to reveal at least one card to the players, and the players are also permitted to view their own three card hand prior to deciding whether to place the Play bet.

When the player wins the game against the dealer, the dealer or banker typically pays 1:1 odds on the Ante bet and the Play bet. In other examples of the invention, higher or lower payouts are made on the Play and Ante bets.

According to one example of the invention, an additional bonus payout is made on the Play bet when the player's hand is one of a predetermined high ranking arrangements of cards. No additional bet is required, and the bonus payout may be paid against the second bet (ante bet) or third bet (play bet) or both bets. An exemplary pay table that pays odds on the second bet (ante bet) and third bet (play bet) for certain bonus hands is shown below:

| Hand | Payout Odds |
|---|---|
| Straight Flush | 5:1 |
| Three of a Kind | 3:1 |
| Straight | 1:1 |

In yet another form of the invention, the dealer and player hands may be combined to form the best three, four, five or six card bonus hand. In one example of the invention, a bonus amount is paid for the best five-card hand made from the dealer's and player's three cards each.

Alternatively, an aspect of the invention may be described as a casino wagering game comprising 1) placing a single first wager (the Super Bonus wager) to participate in the game; 2) a dealer dealing a hand of three cards to each player who placed a wager; 3) resolving the player hands against a plurality of predetermined winning poker outcomes; and 4) resolving each player's hand against a payout table providing payouts for predetermined ranks of poker-type hands; wherein at least some payouts proportional to the single part wager are available in resolving hands for obtaining a predetermined rank of hand. Predetermined winning poker outcomes that have proportional payouts pay odds. "Odds" in this context means payouts that are proportional to the player's wagers (that is, multiples of the wagers), not progressive payouts, fixed payout amounts or payouts that are part of or an entire pot.

According to an example of the present invention, the above-identified steps define one embodiment of an entire game play method. In another example of the invention, an additional game segment or segments, optionally including a three card poker game against a dealer is also played with the same hand of cards. The predetermined winning outcomes can include a single face card, a pair or a higher ranking pair, depending upon the theoretical advantage to the house. When at least some of the outcomes pay odds, the odds may pay between 1:1 and 100:1 on the first single part wager. In another example of the invention, the house pays multiple payouts on the first wager. For example, the house may pay two separate payouts of up to 10:1.

Another aspect of the present invention includes a method of playing a casino card game utilizing a standard deck of cards, comprising the steps of: placing a wager to participate in a three card poker game against a dealer; dealing three cards to each player who placed a wager; dealing at least three cards to the dealer; and resolving the player hands against the dealer hand according to a predetermined hierarchy of three card poker hands. This game play sequence can be played as a stand-alone game, in combination with a three card hand against a pay table and/or other poker-style games. Preferably, the dealer also deals himself three cards. The player's hand must outrank the dealer's hand in order to win the ante bet and any play bet made. Preferably, the dealer's hand must meet a minimum predetermined rank in order to qualify to play against the player. For example, the dealer must hold a 10 or better or a Jack or better or a Queen or better. Otherwise the bet is a push.

According to one aspect of the invention, the player is permitted to view his cards. In addition to an ante wager, the player must then place an additional play bet that the player hand will beat the dealer hand or the player must fold, surrendering the ante (and most likely surrendering the super bonus bet and the optional pair plus bet as the player would remain in the game and make the play bet with at least a pair in the player hand). The invention, however, contemplates allowing the player to stay in the game if he opts not to make the additional bet. In one form of the invention, the player views his own three card hand and at least one dealer card before making the decision on whether or not to place the additional play bet.

An optional feature of the invention is paying a bonus payout on either the ante bet, or the ante bet and additional play bet (both being played against the dealer's hand) if the player's hand is one of a predetermined number of high-ranking winning hands. For example, the player may receive a bonus payout when he has a straight flush. Preferably, no additional bet is required to collect on the bonus payout on the ante bet. In other examples of the invention, a bonus bet is required on the ante bet, and the bonus on the ante bet or play bet pays odds according to a pay table of winning outcomes and corresponding payout multiples.

Although odds payouts on the ante bet (with or without making a play bet) and/or on the super bonus bet is a preferred form of the invention, certain high ranking hands may pay a fixed payout, a proportion of a pot or a progressive payout.

It might be necessary to distribute more than three cards to the dealer or players and to allow the dealer and/or players to use the extra card to make the best three card hand. This dealing modification might be necessary to improve or reduce the house's odds, depending on the other game rules selected. The second bet (ante bet) and bonus bets (e.g., the pair plus bet and the super bonus bet) may be required or optional, depending on house rules.

According to one aspect of the invention, the player may optionally play the player hand in combinations of competition games against the dealer, the game against a pay table or both during each round of play. In other examples of the invention, additional different games are combined with one or more of the game segments (against the dealer and/or against a pay table). For example, the game rules could allow the player to place an additional bet on the occurrence of a five card hand against a pay table, where the dealer deals the player two additional cards after the three card hand against the dealer and/or against the pay table is complete. In another example, the game could also begin with a single, separate wager on One-Card poker or baccarat, using those cards in the three-card poker play. Although the specific type of additional game and the number of cards needed is unimportant to the invention, the use of the original three cards with or without adding more cards to play an additional game is contemplated by the invention.

When the three card game against the dealer is played, it is preferable that the dealer's hand meets a minimum value to qualify to play against the players. For example, the rules may require that the dealer hold a Ten high, Jack high or Queen high hand or better to qualify. If the dealer's hand does not qualify, the third bet (play bet) is returned to the player, and the second bet (ante bet) is paid 1:1. Alternatively, all bets or all other bets made against the dealer or against a pay table are a push or a loss.

According to the invention, the game may be a player banked game, or a house banked game. When a player acts as banker, the house takes a flat fee from each player for each round of play, or takes a percentage of the amounts wagered, depending on the jurisdictional and house rules.

When the rules require the player to place a third wager (the play bet) to stay in the game against the dealer, the player is typically permitted to view his three card hand prior to making the third betting decision. In one example of the invention, the dealer turns one or more cards up prior to the player making the third betting decision. The third bet may be mandatory to stay in the game, or may be optional.

The dealer may also act as banker. The player's cards may be dealt unseen or seen. The cards preferably form a standard 52-card deck, although one or more wild cards (such as a joker(s)) may be used. The game could also be dealt from two or more decks of cards, or from special decks of cards (decks with certain cards removed). The hand preferably consists of three cards, but in some instances, it might be desirable to deal either the players or the dealer one or more additional cards, and allow the player and/or dealer to discard to arrive at the best three card hand. In another example of the invention, players receive three cards, but have the option to discard one or more cards and have them replaced with additional cards, forming a three card "draw" hand.

A bonus payout may be awarded on bets made by the player (e.g., the ante bet and the play bet) for the hand against the dealer, with or without requiring an additional bonus wager for certain predetermined poker hands. In other forms of the invention, bonuses may be awarded to the player for high ranking dealer hands. The bonus payouts may pay a fixed amount, odds, and a percentage of a pot or a progressive jackpot amount. Preferably, bonus amounts are paid without requiring a separate bonus wager according to an odds pay table. Bets or bonuses may also be paid for ties in rank or ties in rank may cause the player to lose or push with the dealer hand of equal rank.

In the case of one preferred three card version of the game, hands are preferably ranked as follows, where A=ace, K=king, Q=queen, J=jack and numbers 10 to 2 designate the other cards:

Highest:

BRAG: Three cards of one suit in sequence

AKQ highest ranking brag
KQJ next highest ranking brag
QJ10 next highest ranking brag, and so on until
32A lowest ranking brag TRIPS: Three cards of one Rank AAA highest
KKK next highest ranking trips, and so on, until
222 lowest ranking trips RUN: Three cards of mixed suits in sequence AKQ highest ranking
KQJ next highest ranking, and so on, until
32A lowest ranking FLUSH: Three cards of One Suit AKJ highest ranking
AK10 next highest, and so on, until
532 lowest ranking PAIR: Two cards of the Same Rank AAK highest ranking
AAQ next highest ranking, and so on, until
223 lowest ranking Lowest:

HIGH CARD (a hand comprising none of the above combinations)

AKJ highest ranking
AK10 next highest ranking, and so on, until
532 lowest ranking
Ace is high, but can be low in 3-2-A Sequence.

Those skilled in the art will appreciate that various other names may be used for the hands in the illustrative hierarchy set forth herein. Other hierarchy's are contemplated. For example, BRAG may also be known as a royal flush (for AKQ), straight flush or bouncer; TRIPS may also be known as three of a kind or PRILE; and a RUN may also be known as a STRAIGHT.

The payout may be made in accordance with a predetermined scale. For example, one possible payout scheme is as follows:

| | | |
|---|---|---|
| Straight Flush | About 40 to 1 | (Range of 25 to 100 to 1) |
| Three-of-a-kind | About 30 to 1 | (Range of 10 to 50 to 1) |
| Straight | About 6 to 1 | (Range of 4 to 12 to 1) |
| Flush | About 4 to 1 | (Range of 3 to 12 to 1) |
| Pair | About 1 to 1 | (Range of 1 to 3 to 1) |
| High Card Rank | About 0.5 to 1 | (Range of 0.2 to 1 to 1) |

The payouts may be at different rates that are proportional to the original wager, but not necessarily whole number multipliers, such as 2 to 1 or 14 to 5 for a pair. Those skilled in the art will appreciate that the payouts may be varied without departing from the scope of the present invention. Whole number multipliers simplify the resolution of wagers at the table and are therefore preferable. In other forms of the invention, at least some of the payouts are fixed in amount regardless of the amount wagered, are a percentage of a jackpot or progressive jackpot amount.

The method may further comprise the step of permitting or requiring a player to place a wager on a fixed or variable extra bonus jackpot, but this is a less preferred embodiment in some instances. For example, when a game is offered in a California card room, players bank the game. In order for players to feel they can afford to bank a particular game, the payout odds must be kept low enough to prevent players from avoiding their turn banking the game. The bonus payouts are therefore preferably eliminated in player-banked versions of the invention. Higher payout odds are acceptable in a more traditional Las Vegas style casino where the house banks the game.

Another embodiment of the present invention comprises the steps of: designating at least one playing card indicia as a wild indicia; placing a single part wager to participate in a casino three-card poker-type game; a dealer dealing a hand consisting of three cards to each player who placed a wager; and playing a three-card poker-type hand wherein said wild indicia is used where present in any of said hands; resolving each player's hand according to predetermined poker rules, wherein at least some payouts proportional to the single part wager are made for obtaining a predetermined winning hand.

In an alternative three-card embodiment of the present invention, each player receives two standard playing cards plus a wild card that the player combines with the standard cards to make a three-card hand. The payout scale and predetermined ranks may be chosen or modified to reflect the increased probability of a high ranking hand being produced. A common wild card or a common card may also be used, again with pay tables modified to reflect the increased potential or at least changed potential for higher ranked hands.

Such wild cards serve to add excitement and create higher hand values. Wild cards could also be designed to be retained permanently by players and if decorated appropriately by an issuing casino or the like would serve the dual purpose of a playing card and a promotional item. Wild cards may be used in this way in conjunction with other forms of card games. Alternatively, the wild card can be printed on the player area of the layout.

The invention also provides game apparatus for use in playing the card-type games of the present invention. For example, the games of the present invention are readily adaptable for play on a board game, computer game, or on a gaming device, such as a video gaming device. For example, one aspect of the present invention comprises an apparatus for playing a card-type game comprising: display element (e.g., board, screen, table cards, play sheet, etc.) for informing at least one player of a hierarchy of a plurality of possible hands and a predetermined plurality of winning card combinations; an area or position for receiving at least one wager selection from a plurality of wagering options by at least one player, wherein the wagering comprises whether a player's hand attains at least one of said predetermined plurality of winning combinations; and a surface or display area for displaying a plurality of indicia of playing cards to form at least one player's three-card hand.

According to a further aspect of the invention there is provided apparatus for use in playing a card game in which all possible hands of cards are ranked according to predetermined poker-type rules, the apparatus comprising at least one player's playing area, each player's playing area comprising a first zone in which a player may place a wager that the player's hand will be greater than a first predetermined rank, and a second zone for display of the player's hand.

The apparatus may also incorporate a chip tray to receive playing chips, the chip tray being placed in a position adjacent to or otherwise convenient to the dealer. The apparatus may also incorporate an area or receptacle for cards not in play and a shuffler and card shoe. The apparatus may comprise a rigid playing surface of board, plastic or other suitable material or may comprise a cloth or other flexible material defining a playing surface. The apparatus may also be a video simulation of a multi-player card game, including a virtual dealer and multiple player positions.

In a preferred form, the surface is of generally semi-circular form, the dealer's playing area being located proximate the straight edge of the playing surface or centrally thereof and the players' playing areas being disposed side-by-side in arcuate array adjacent the curved edge of the playing surface.

The various embodiments of the present invention are directed to three-card poker-type games wherein indicia of playing cards are displayed to at least one or more players. As used herein, the phrase "indicia of playing cards" is meant to include actual playing cards, as well as images of playing cards displayed either mechanically, electro-mechanically, electronically or otherwise. For example, it is well within the scope of the present invention to display indicia of playing cards on an actual board game, on a mechanical slot machine, on an electronic gaming device, on another video screen, on video displays at individual player positions (with cards generated by a random selection device, such as a random number generator associated with a set of visual data of card elements) or utilizing another form of image generation such as holography. Similarly, the phrase "indicia of wild cards" as used herein may include jokers from a standard deck of playing cards but may also comprise other indicia that, according to rules of the game, may be used for at least one other value.

FIG. 1 shows a playing surface or table layout 10 on which one or more embodiments of the present invention may be played. Either the game against the dealer alone, a game against the pay table alone or both (either with both segments optional or mandatory) may be played on the exemplary layout. The layout 10 may be marked or placed on any suitable surface such as a gaming table. For example, the layout may be in the form of a layout cloth supported on a supporting surface. The layout provides a playing area 12 for a plurality of players, for example seven players, and a separate area 14 for the dealer. Each playing area 12 has a marked section or zones 16 for the placing of the first wager by a player as will be described hereinafter.

Each player takes a place at one of the areas 12. The game is played as a round as will be described below. In an example of the invention that includes the player placing a bet against a pay table, each player wagers that the rank of his hand will exceed a minimum predetermined value. On one example, the minimum value is a pair. The game can be played with a standard 52-card deck, or a modified deck, such as a deck with the lower ranking cards (2's, 3's, 4's and 5's) stripped out, for example. At the commencement of the game, each player decides whether to play the particular round by wagering against the "PAIR PLUS" (the first) wager. "PAIR PLUS" is a designation meaning that the poker ranking of the hand must include a pair or better. The gaming chips used in the Pair Plus wager may be of any conventional kind and are available in a number of denominations such as are well known within the art. If the player wishes (alternatively or in addition) to make a wager based on the value of his hand, he places an appropriate token or chip on PAIR PLUS section 16 of his playing area 12. In the present example, the rules of the game provide that payouts will be made according to a displayed payout schedule with "PAIR PLUS" payouts starting at a pair or better. In a preferred three-card version of the game, hands are preferably ranked according to the following hierarchy, though other rankings may be used:

Highest:

BRAG: Three of one suit in sequence

AKQ highest ranking brag
KQJ next highest ranking brag
QJ10 next highest ranking brag, and so on
until
32A lowest ranking brag TRIPS: Three of One Rank AAA highest
KKK next highest ranking trips, and so on
until
222 lowest ranking trips RUN: Three of mixed Suits in sequence AKQ highest ranking,
KQJ next highest ranking, and so on,
until
32A lowest ranking FLUSH: Three of One suit AKJ highest ranking
AK10 next highest, and so on, until
532 lowest ranking PAIR: Two of Same Rank AAK highest ranking
AAQ next highest ranking, and so on,
until
223 lowest ranking Lowest:

HIGH CARD (a hand comprising none of the above)

AKJ highest ranking
AK10 next highest ranking, and so on,
until
532 lowest ranking
ACE is high, but can be low in 3-2-A Sequence.

The payout schedule may be varied in accordance with rules of the game and/or by the casino. For example, one preferred payout schedule is as follows:

| | |
|---|---|
| Straight Flush | 40 to 1 |
| Three-of-a-kind | 30 to 1 |
| Straight | 6 to 1 |
| Flush | 4 to 1 |
| Pair | 1 to 1 |

Alternatively, in a gaming establishment or jurisdiction where high odds payouts are not favored, a wager can be made solely that the value of the hand will be a pair or greater, King high or greater, Queen high or greater, and the like, and the payout may be, for example, 14 to 5, or whatever other payout is found to be appropriate or desirable.

The display area 22 may include a pay table that appears on the playing surface 12, on a "how to play" card (also known as a "rack card"), or on a plaquard within the view of the players. It is also desirable to position the pay tables proximate the dealer to assist the dealer in resolving the hands. In an alternative arrangement, details of payouts and any extra bonus payouts may be marked on separate displays, such as vertical or supported signs on the table top.

When the above wager is in place on area 16, the dealer preferably shuffles the cards (manually or with an automated shuffling apparatus) and then deals a three-card hand to each player and to himself. The cards may initially be dealt to the players face up or face down, depending upon casino policy.

"PAIR PLUS" wagers are not affected by player inspection. A player playing "PAIR PLUS" only, places his cards in the playing area. If the player reveals a pair or greater to the dealer, with either the dealer or the player exposing the player's cards, the player will be paid appropriately for the wager. Players who have wagered on the value of the hand (i.e., PAIR PLUS wagers) win if the hand is at least a pair, and are paid by the banker according to the posted scale. These payouts are independent of any other potential play with the cards or continued play with additional cards. This procedure completes a single round of the game, when only the PAIR PLUS bet is played. Play then continues in another round, with players commencing by making additional PAIR PLUS wagers. Super Bonus bets may be similarly treated.

According to another aspect of the invention, when the player wishes to make a bet against the dealer, either with or without making the PAIR PLUS bet, he places a wager in the "ANTE" area 18. In the following example, the player is playing only the ANTE bet, and is not participating in the PAIR PLUS game. The player places the ANTE, and then receives three cards. The dealer also deals himself three cards. The player is permitted to view his cards prior to determining whether to make an additional "PLAY" bet in area 20, or fold. In another example of the invention, the player can opt not to make the PLAY wager and remain in the game. In yet another example, the dealer reveals one or more cards to the player, and this information in combination with the knowledge of the player's hand is used to determine whether the PLAY bet should be made.

In a preferred form of the invention, the dealer's hand must meet a minimum ranking in order to qualify to play against the players. In one example, the dealer must have a hand of a Ten or better, Jack or better, or Queen or better, otherwise the play wager is returned, and the ante is paid 1:1. In another example, when the dealer does not qualify, both the ANTE and PLAY bets are returned to the player. When the dealer's hand qualifies, the player's hand must beat the dealer's hand in order to win the Ante and Play bets. In a preferred form of the invention, the ante and play bets are paid 1:1 when the player's hand outranks the dealer's hand.

In the examples outlined above, only the PAIR PLUS or the ANTE/PLAY (or ANTE) betting options are permitted from round to round. In other words, the game can be played in a PAIR PLUS only format or in a ANTE/PLAY or ANTE only format. In another example, both betting options are permitted within the same game, and the player has the option of playing one, or the other, or both on any given round. Alternatively, both the PAIR PLUS and ANTE/PLAY (or ANTE) may be required in each round of play. In yet other examples, the PAIR PLUS and ANTE/PLAY or ANTE can be individually or together, in combination with additional games that utilize the three card poker hand to play additional games. For example, the player might make the PAIR PLUS bet and additional bet on a five card stud game. At the conclusion of the PAIR PLUS three card game, the dealer gives the player two more cards to play a hand of five card poker. The number of cards and the specific subsequent game are unimportant to the invention. What is important is that the cards originally dealt be used in a subsequent segment of play. The player can also make an ANTE/BET wager and a five card stud wager, or both the ANTE/BET and PAIR PLUS wager and five card stud wager. As with the example of the invention described above that describes the ANTE/BET wagering embodiment, a bonus payout as shown in pay table 26 may also be provided for awarding the player for a predetermined high ranking poker hand against the dealer.

The novel methods of the present invention may be played utilizing playing cards as illustrated above, or on an electrical or electromechanical device such as a gaming machine. Those skilled in the art will appreciate that suitable controls can be provided for receiving the necessary input and therefore will not be described in detail herein. While the gaming device is intended for play by a single player against the playing device, it is also within the scope of the present invention to provide a multi-unit video format wherein a plurality of players may play against each other and/or against a dealer. Similarly, from the present description, those skilled in the art will appreciate that the novel games of the present invention are readily adaptable for play either within a gaming establishment or at a remote location, such as on a terminal provided in a commercial aircraft or in a hotel room within a casino, for example. Furthermore, the game is readily adaptable to a scratch card format.

From the present description, those skilled in the art will appreciate that various modifications may be made without department from the scope of the present invention. For example, the naming of the wagers, the naming and/or ranking of any hand, the payout schedule and predetermined winning or losing ranks may be varied in accordance with the requirements of the casino. The table layout may be varied from that described and shown. The rules may be varied, or additional rules imposed, within the scope of the invention.

In particular, there may be introduced a further option of a player wagering on a high odds payout wager or on a fixed or variable jackpot which is paid out in accordance with rules of the casino on a premium hand, or when a high ranked hand is beaten by the dealer. Examples of odds available could be 5000 to 1 or more against a royal flush—ace, king, queen suited or up to 250,000 to 1 or more against consecutive straight flushes.

If the game incorporates a jackpot or a numerical hand value wager, separate designated wagering areas may be provided for these wagers. These may be incorporated at any convenient position on the players' playing areas. The display stand, the wild and promotional card may also be modified or omitted as desired. Whilst the game is described particularly for play in a gaming establishment, it is not limited in this respect and may also be played for example in a domestic environment or in the format of a video game, slot machine, parlor game, lottery-style game or the like.

Figure 2:
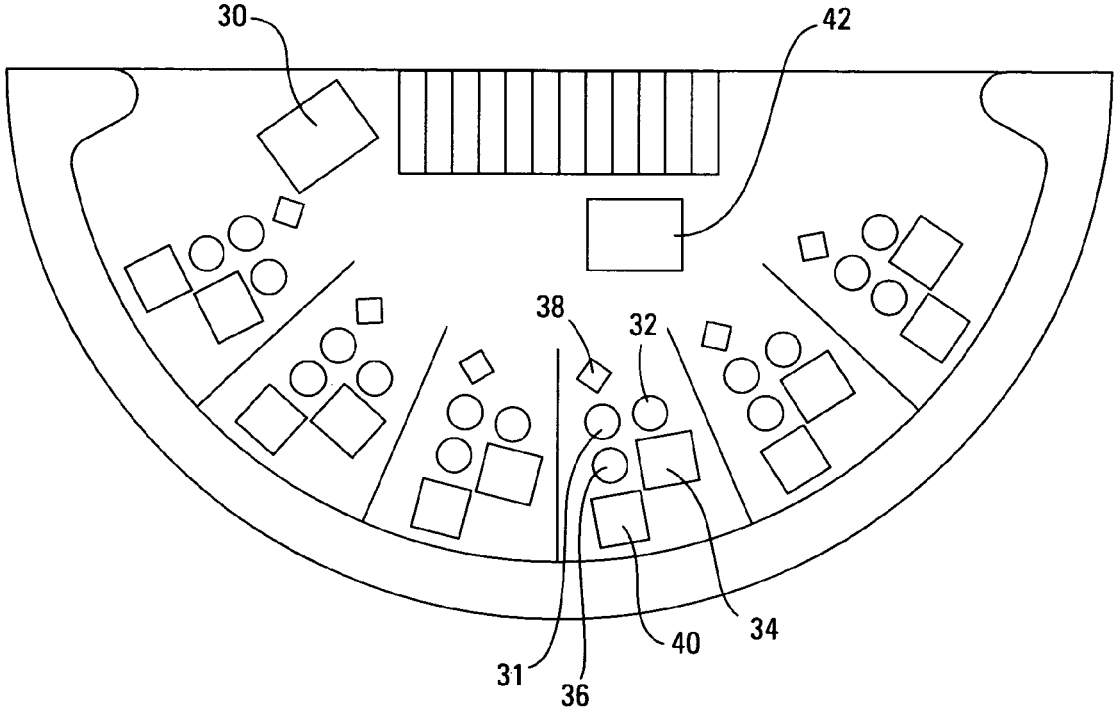
FIG. 2 shows an enlarged view of a playing position on a playing surface for use in playing a card game of another embodiment of the present invention.

In another preferred form of the invention, players play on a play area as shown in FIG. 2. The following example of the present invention is referred to as Oklahoma Three Card™ poker. Although it is preferred that the game be played with three cards, the game could be played with more or fewer cards. Cards may be dispensed from an automatic card shuffler 30 or the cards may be hand pitched. For example, the game could be played as a five card game, six card game, seven card game, four card game or a two card game.

In this form of the invention, the player places an ante bet on betting circle 31 to participate in a head to head game against the dealer. The player must also make a Super Bonus bet on betting circle 32. On other forms of the invention, the Super Bonus bet is optional, and the bet against the dealer is optional while the Super Bonus bet is mandatory. The Super Bonus bet is a bet against a pay table. The pay table is preferably printed in area 34 on the table felt, in full view of the player.

In this form of the game, the player is dealt a hand of three cards, and the dealer deals himself two hands of three cards each, in one manner or another designating one hand as a first hand and the other hand as a second hand. The dealer views his first hand of cards and determines if the ranking of his hand is equal to or exceeds a maximum value, for example, a straight or better. It is to be understood that the particular ranking chosen as the maximum is a matter of choice, and that other maximum hand rankings are possible according to selectable rules of play. If the dealer has a hand that is too high ranking (it equals or exceeds the maximum hand ranking), the hand is disqualified and the dealer must discard the first hand and play the second hand. In other forms of the invention, the dealer has an unlimited number of substitute hands from which to draw if the previous dealer hand is too high a ranking. However, the chances of receiving a second hand that exceeds the maximum hand ranking after receiving a first hand that exceeds the maximum allowable hand ranking is very minimal.

Imposing a rule that requires the dealer to discard a hand that is too good has a number of advantages. First and foremost, it gives the player a perceived advantage over the dealer because the player is not required to similarly discard his hand if it is "too good." This rule allows the player to beat the dealer hand more than 50% of the time, which is a rate that is virtually unheard of prior to the present invention. In all prior art games, to the inventor's knowledge, the frequency of winning, (referred to in the trade as the hit frequency) is always less than 50%, providing the house advantage. But the betting structure of this form of the invention also has other features that counteract this advantage, such that the house still has an overall advantage in playing the game.

According to this preferred form of the invention, the Super Bonus bet is mandatory. However, the bet is or should be always won by the house if the player's hand is not of a predetermined minimum winning poker ranking. According to this example of the invention, the house takes this bet unless the player's hand outranks the dealer's hand, or the player obtains one of a number of predetermined hand rankings. If the player's hand is not of sufficient rank to win the super bonus, but the player hand beats the dealer hand in rank, the bet is a push. If the player's hand is of a sufficiently high rank, the player is paid odds posted in the Super Bonus pay table 34. The Super Bonus bet in this form of the invention compensates for the edge in favor of the player created by the dealer qualification step (when the dealer discards when the ranking of his hand is too high).

According to this example of the invention, the player has an opportunity to view his cards and then make a play bet in wagering circle 36 on the table layout. This play bet can be equal to or unequal to the Ante, although preferably the Ante bet and Play bet are equal and conform to the table limits set by the casino. The player may make the bet wager with or without complete or partial knowledge of the dealer's hand ranking, although it is preferred that the player not have complete knowledge of the dealer's hand at the time of making the bet. In an alternative form of the invention, the player can opt not to make the play bet or play wager and continue to play. If the player beats the dealer, he or she is paid 1:1 on the ante bet and play bet. The Super Bonus bet is resolved according to the pay table printed in area 34, with the exception that the house does not automatically sweep the Super Bonus bet in the event that the dealer does not have a predetermined minimum ranking hand. If the player's hand exceeds the dealer hand in rank and the player's hand is not one of a predetermined winning hands, then the Super Bonus bet is a push.

Another distinctive feature of the invention is that the dealer's hand must additionally qualify with a minimum ranking in order for the dealer to qualify for play. If the dealer does not qualify, the player is paid 1:1 on the Ante and the play bet is returned to the player. The Super Bonus bet is resolved in the same manner as described above—that is, independently of the player hand against the dealer hand.

In addition to the bets described above, Oklahoma Three Card™ poker also provides the player with an opportunity to place an optional Bonus bet (e.g., the Pair Plus bonus bet) in player area 38. If the player obtains one of a predetermined winning bonus hands, and the bonus bet has been placed, the player additionally wins a bonus amount. In this example of the invention, all payouts on the Bonus bet (e.g., the Pair Plus bet) and corresponding winning hands are displayed on a bonus pay table printed in area 40 on the layout. Preferably, bonus hands are a subgroup of winning combinations in the Super Bonus pay table. An example of the Super Bonus and Pair Plus Bonus pay tables are shown below:

| Pay Table 1 | Pair Plus | Super Bonus |
|---|---|---|
| Mini Royal | 50 to 1 | 50 to 1 |
| Straight Flush | 40 to 1 | 11 to 1 |
| Three of a Kind | 30 to 1 | 9 to 1 |
| Straight | 6 to 1 | 3 to 1 |
| Flush | 4 to 1 | 3 to 2 |
| Pair of 6s or better | 1 to 1 | 1 to 1 |
| Other pairs | 1 to 1 | |
| House edge: | 2.14% | |

| Pay Table 2 | Pair Plus | Super Bonus |
|---|---|---|
| Mini Royal | 50 to 1 | 50 to 1 |
| Straight Flush | 40 to 1 | 11 to 1 |
| Three of a Kind | 30 to 1 | 9 to 1 |
| Straight | 5 to 1 | 3 to 1 |
| Flush | 4 to 1 | 3 to 2 |
| Pair of 6s or better | 1 to 1 | 1 to 1 |
| Other pairs | 1 to 1 | |
| House edge: | 5.39% | |

| Pay Table 3 | Pair Plus | Super Bonus |
|---|---|---|
| Mini Royal | 50 to 1 | 50 to 1 |
| Straight Flush | 40 to 1 | 11 to 1 |
| Three of a Kind | 30 to 1 | 9 to 1 |
| Straight | 6 to 1 | 3 to 1 |
| Flush | 3 to 1 | 3 to 2 |
| Pair of 6s or better | 1 to 1 | 1 to 1 |
| Other pairs | 1 to 1 | |
| House edge: | 7.10% | |

Although the bonus awards in this example of the invention are based on the fact that the player is required to make an optional bonus bet in area 38, other forms of the invention do not require a separate bonus bet. These numbers may be considered approximate numbers, such that the description of providing 50:1 payout would not be avoided by a 45:1 payout.

In each of the examples provided above, the bonus pay table is a subset of the Super Bonus pay table. In other forms of the invention, winning hands need not be shared by both pay tables. For example, the game could be configured to pay a payout for a mini-royal only if the player placed the optional bonus side bet.

The table layout also includes a separate area 42 for the dealer's second hand. This hand is only played if the dealer's first hand is equal to or higher in rank than a predetermined maximum hand ranking.

What is claimed is:

1. A method of playing a poker-type wagering game, comprising:

placing a mandatory Ante bet to participate in a poker-type card game against a dealer hand;

placing a mandatory Super Bonus bet on the occurrence of one of a predetermined plurality of winning poker hands;

a dealer dealing at least two hands of cards to the dealer position and a hand of cards to each player participating in the game;

and when the dealer's first hand meets or exceeds a predetermined high ranking hand value, discarding the first hand and playing the second hand;

each player placing an additional mandatory Bet after viewing at least the player's hand of cards to stay in the game;

resolving each player hand against the dealer hand;

paying the player on the Ante and Bet if the player's hand ranking exceeds that of the dealer; and paying the player on the Super Bonus bet if the player hand is one of a plurality of predetermined winning poker hands.

2. The method of claim 1, wherein a number of cards in each hand is selected from the group consisting of two, three, four, five, six or seven cards.

3. The method of claim 1, wherein a number of cards in each hand is three cards.

4. The method of claim 1, wherein the dealer deals both of the at least two hands to the dealer position prior to the start of the game.

5. The method of claim 1, wherein the dealer's hand must qualify to play with a predetermined minimum hand ranking.

6. The method of claim 1, wherein the predetermined high ranking hand value is a flush.

7. The method of claim 6, wherein the Super Bonus bet is collected by the house if the player's hand is lower ranking than the dealer's hand.

8. The method of claim 5, wherein if the dealer does not qualify, and the player hand beats the dealer hand, the Super Bonus bet is a push.

9. The method of claim 1 wherein the player is paid for obtaining one of a predetermined winning poker hands, regardless of the ranking of the dealer's hand.

10. The method of claim 1 wherein the player is only paid for obtaining one of a predetermined winning poker hands, providing that the dealer's hand meets or exceeds a predetermined minimum qualifying ranking.

11. The method of claim 1, wherein the Ante and Bet are equal.

12. The method of claim 1, wherein the Ante and Super Bonus bets are equal.

13. The method of claim 1, wherein at least two of the Ante, Bet and Super Bonus bets are unequal.

14. The method of claim 1, wherein the Super Bonus bet is resolved against a pay table.

15. The method of claim 1, wherein the Super Bonus bet is paid according a payment method from the group consisting of: a fixed payout amount, a pay table with predetermined winning hands and corresponding payout odds, and at least a portion of a progressive payout amount.

16. A method of playing a poker-type wagering game, comprising:

placing a mandatory Ante bet to participate in a poker-type card game against a dealer hand;

placing a mandatory Super Bonus bet on the occurrence of one of a predetermined plurality of winning poker hands;

a dealer dealing at least one hand of cards to the dealer position and a hand of cards to each player participating in the game;

each player qualifying to play with a minimum predetermined poker ranking;

each player placing an additional mandatory Bet after viewing at least the player's hand of cards to stay in the game;

resolving each player hand against the dealer hand;

when the player's hand qualifies with a minimum predetermined poker ranking, paying the player on the Ante Bet when the player's hand ranking exceeds that of the dealer;

when the player's hand does not qualify but the player hand beats the dealer hand, returning the Super Bonus bet to the player; and paying the player on the Super Bonus bet when the player hand is one of a plurality of predetermined winning poker hands.

17. The method of claim 16, wherein a number of cards in each hand is selected from the group consisting of two, three, four, five, six or seven cards.

18. The method of claim 16, wherein a number of cards in each hand is three cards.

19. The method of claim 16, wherein the dealer deals two hands to the dealer position, and the dealer plays with the first hand unless the ranking meets or exceeds a preselected hand ranking, wherein the dealer discards the first hand and plays the second hand.

20. The method of claim 16, wherein the dealer's hand must qualify to play with a predetermined minimum hand ranking.

21. The method of claim 19, wherein the preselected high ranking hand value is a flush.

22. The method of claim 16, wherein the Super Bonus bet is collected by the house if the player's hand is lower ranking than the dealer's hand.

23. The method of claim 20, wherein if the dealer does not qualify, and the player hand beats the dealer hand, the Super Bonus bet is a push.

24. The method of claim 16 wherein the player is paid on the Super Bonus bet for obtaining one of a predetermined number of winning poker hands, regardless of the ranking of the dealer's hand.

25. The method of claim 16 wherein the player is only paid for obtaining one of a predetermined winning poker hands, providing that the dealer's hand meets or exceeds a predetermined minimum qualifying ranking.

26. The method of claim 16, wherein the Ante and Bet are equal.

27. The method of claim 16, wherein the Ante and Super Bonus bets must be equal.

28. The method of claim 16, wherein at least two of the Ante, Bet and Super Bonus bets are unequal.

29. The method of claim 16, wherein the Super Bonus bet is resolved against a pay table.

30. The method of claim 16, wherein the Super Bonus bet is paid according a payment method from the group consisting of: a fixed payout amount, a pay table with predetermined winning hands and corresponding payout odds, and at least a portion of a progressive payout amount.

31. The method of claim 1, and further comprising the step of placing an optional wager on the occurrence of one of a predetermined number of winning card combinations.

32. The method of claim 16, and further comprising the step of placing an optional wager on the occurrence of one of a predetermined number of winning card combinations.

33. The method of claim 31, wherein the player is paid odds on the optional wager for one of a predetermined winning poker hand combinations.

34. The method of claim 32, wherein the player is paid odds on the optional wager for one of a predetermined winning poker hand combinations.

* * * * *